US011400353B1

(12) United States Patent
Mecham

(10) Patent No.: US 11,400,353 B1
(45) Date of Patent: Aug. 2, 2022

(54) SETTING TOOL FOR GOLF BALL AND GOLF TEE

(71) Applicant: Doyle Mecham, Henderson, NV (US)

(72) Inventor: Doyle Mecham, Henderson, NV (US)

( * ) Notice: Subject to any disclaimer, the term of this patent is extended or adjusted under 35 U.S.C. 154(b) by 0 days.

(21) Appl. No.: 17/564,020

(22) Filed: Dec. 28, 2021

Related U.S. Application Data

(60) Provisional application No. 63/152,286, filed on Feb. 22, 2021.

(51) Int. Cl.
*A63B 57/00* (2015.01)

(52) U.S. Cl.
CPC ..... *A63B 57/0037* (2013.01)

(58) Field of Classification Search
CPC ..... A63B 57/0037; A63B 47/02
See application file for complete search history.

(56) References Cited

U.S. PATENT DOCUMENTS 4,526,369 A * 7/1985 Phelps ..... A63B 47/02 473/133
4,616,826 A * 10/1986 Trefts ..... A63B 57/0037 473/133
4,819,938 A * 4/1989 Hill ..... A63B 47/02 473/133
4,949,961 A * 8/1990 Milano ..... A63B 47/02 473/133
5,171,010 A * 12/1992 Lanoue ..... A63B 45/02 473/132
5,205,598 A * 4/1993 Miller ..... A63B 57/0037 294/19.2
5,330,177 A * 7/1994 Rogge ..... A63B 47/02 294/19.2
5,669,646 A * 9/1997 Fiocca ..... A63B 57/203 294/19.2
5,707,303 A * 1/1998 Berkowitz ..... A63B 57/0037 294/19.2
6,254,497 B1 * 7/2001 Brant ..... A63B 47/02 473/406
6,843,737 B1 * 1/2005 Smith ..... A63B 57/0037 473/386
8,191,946 B1 * 6/2012 McGary ..... A63B 47/02 294/19.2
8,529,379 B1 * 9/2013 Faircloth ..... A63B 57/0037 294/19.2

(Continued)

FOREIGN PATENT DOCUMENTS

WO WO-2004056426 A1 * 7/2004 ..... A63B 57/0037

*Primary Examiner* — Steven B Wong
(74) *Attorney, Agent, or Firm* — Quickpatents, LLC; Kevin Prince

(57) ABSTRACT

A tool for a golfer for manipulating a golf ball and a golf tee while in a standing position includes an elongated body having a fixed handle and a pivotable trigger fixed proximate an upper end thereof. A setting block is fixed at a lower end of the elongated body and is adapted for receiving either the golf ball or the golf tee partially therein. A pivotable grasping finger is fixed proximate the lower end of the elongated body proximate the setting block. A linkage is secured at a lower end thereof with the grasping finger, and at an upper end thereof with the trigger. As such, the grasping finger moves from the open position to the closed position when the trigger is moved from the first position to the second position, respectively.

15 Claims, 7 Drawing Sheets

(56) References Cited

U.S. PATENT DOCUMENTS

| | | | | |
|---|---|---|---|---|
| 2002/0155897 | A1* | 10/2002 | Schmitt | A63B 47/02 473/286 |
| 2003/0069090 | A1* | 4/2003 | Gill | A63B 57/0037 473/386 |
| 2003/0203772 | A1* | 10/2003 | Paine | A63B 57/0037 473/386 |
| 2005/0181886 | A1* | 8/2005 | Zmetra | A63B 57/0037 473/286 |
| 2007/0072691 | A1* | 3/2007 | Berry | A63B 57/0037 473/132 |
| 2018/0369664 | A1* | 12/2018 | Jensen | A63B 57/0037 |

* cited by examiner

SETTING TOOL FOR GOLF BALL AND GOLF TEE

CROSS-REFERENCE TO RELATED APPLICATIONS

This application claims the benefit of U.S. Provisional Patent Application 63/152,286, filed on Feb. 18, 2021, and is incorporated herein by reference.

STATEMENT REGARDING FEDERALLY SPONSORED RESEARCH AND DEVELOPMENT

Not Applicable.

FIELD OF THE INVENTION

This invention relates to golf accessories, and more particularly to a setting tool for setting golf balls and golf tees.

BACKGROUND

The game of golf is enjoyed by many people, and as golfers age it sometimes becomes difficult to frequently bend down to pick a golf ball or golf tee up off of a ground surface. To date, however, there are no viable solutions to avoid the golfer having to bend down to set his ball upon the golf tee, and then bend down again after hitting the ball to retrieve the golf tee.

Therefore, there is a need for a device that allows a golfer to both set the golf tee into the ground and then place the golf ball atop the golf tee. Such a needed invention would further allow the golfer to retrieve the golf tee, without bending down, after striking the golf ball. Such a needed device would provide means for easily attaching the device to the golfer's pants while not in use, allowing for convenient storage and transport. Such a needed product would accommodate both golf tees and golf balls, without having to interchange or manipulate a lower end of the tool. The present invention accomplishes these objectives.

SUMMARY OF THE INVENTION

The present device is a tool used by a golfer for manipulating a golf ball and a golf tee. Such a tool is useful for allowing the golfer to manipulate the golf ball and the golf tee without having to bend down to a ground surface. The tool includes an elongated body having an upper end, a lower end, and a channel connecting the upper end with the lower end.

A handle is fixed at the upper end of the elongated body and adapted for being grasped by a hand of the golfer. A trigger is fixed proximate the upper end of the elongated body proximate the handle and is adapted to pivot within the channel of the elongated body between a first position and a second position.

A rigid setting block is fixed at the lower end of the elongated body and is adapted for receiving either the golf ball or the golf tee partially therein. The setting block includes a tee holder and a ball holder.

In some embodiments the setting block is affixed to a pre-existing grasping tool having the elongated body, handle, trigger, grasping finger, and linkage. Such a pre-existing grasping tool can be adapted to receive the setting block.

A rigid grasping finger has a proximal end, a central portion, and a distal end. The grasping finger is fixed proximate the lower end of the elongated body proximate the setting block, and is adapted to pivot within the channel of the elongated body between an open position and a closed position. A spring mechanism is adapted to urge the grasping finger towards the open position. In some embodiments the grasping finger includes an elastomeric sleeve for increasing friction between the golf ball and the grasping finger.

A linkage, such as a flexible string, is secured at a lower end thereof with the grasping finger, and at an upper end thereof with the trigger. The linkage substantially traverses the channel of the elongated body. As such, the grasping finger moves from the open position to the closed position when the trigger is moved from the first position to the second position, respectively.

In use, with the golf tee engaged with the setting block, the golfer pulls the trigger towards the second position to cause the grasping finger to lock the golf tee in place in the setting block. Thereafter the golfer pulls the trigger towards the second position to cause the grasping finger to lock the golf tee in place in the setting block. The golfer, even in a standing position, can set the golf tee into the ground surface and release the trigger to cause the grasping finger to release the golf tee. Once the golf tee is set into the ground surface, the golfer can lift the tool, set the golf ball into the setting block, and pull the trigger again towards the second position to lock the golf ball in place in the setting block. The golfer can then, still in the standing position, place the golf ball onto the golf tee, release the trigger, thereby releasing the golf ball onto the golf tee, all without the golfer having to bend down.

In some embodiments a spring clip is included proximate the upper end of the elongated body. The spring clip can be manually positioned between a closed position and an open position, the spring clip being urged by a spring into the closed position. As such, the spring clip can be used to clip the tool onto pants of the golfer for convenient transport.

Preferably the channel of the elongated body can be closed around the linkage with an elongated channel cover, the elongated channel cover fixed with the elongated body with one or more mechanical fasteners.

The present invention is a device that allows a golfer to both set the golf tee into the ground and then place the golf ball atop the golf tee. The present invention further allows the golfer to retrieve the golf tee, without bending down, after striking the golf ball. The present device provides a spring clip for easily attaching the device to the golfer's pants while not in use, allowing for convenient storage and transport. The present invention accommodates both golf tees and golf balls, without the golfer to exchange or manipulate a lower end of the tool. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
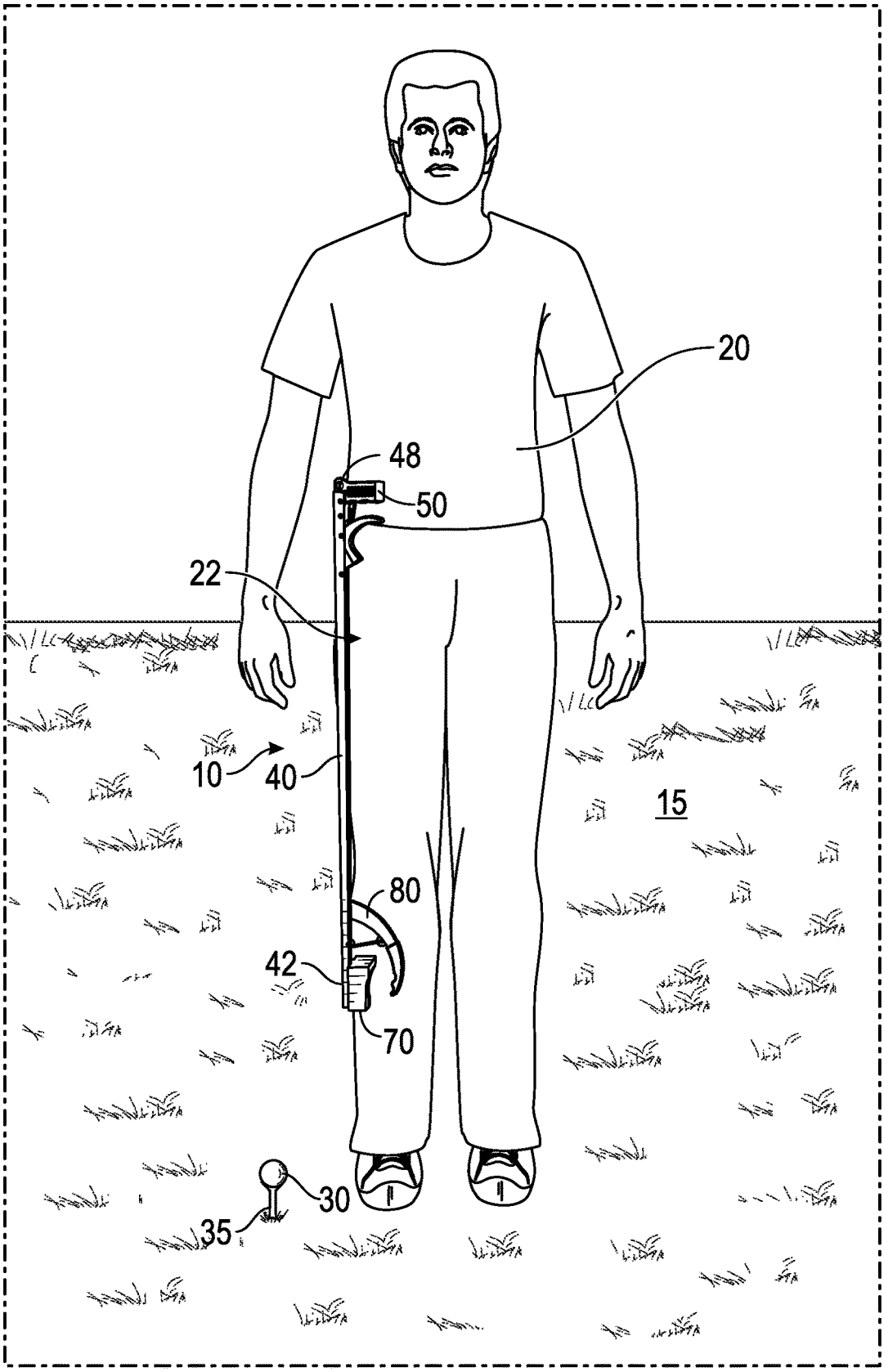
FIG. 1 is a perspective view of the invention, illustrated as stowed on a golfer.
Figure 3:
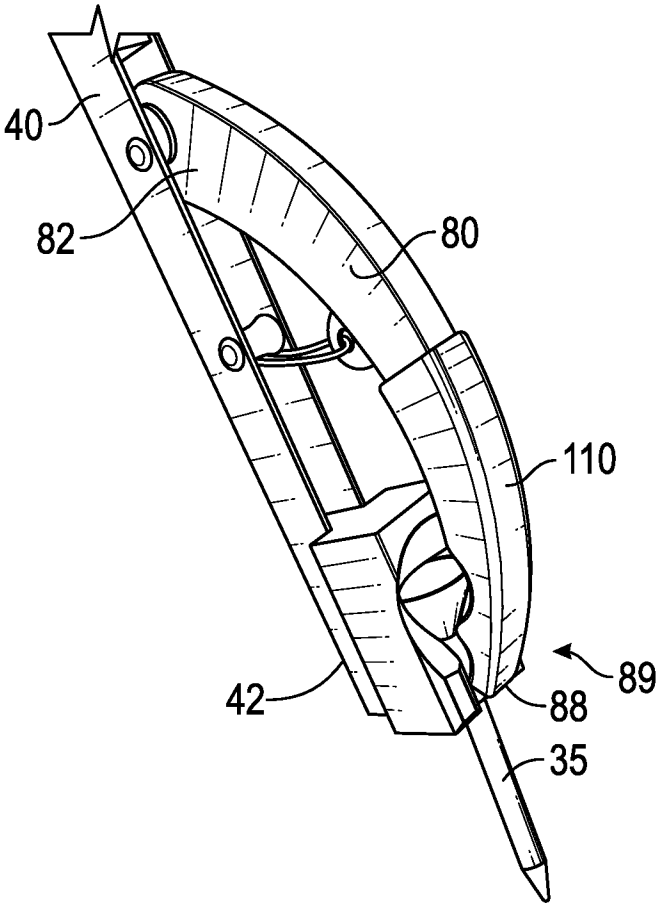
FIG. 3 is an enlarged partial perspective view of the lower end of the elongated body of the invention, illustrating the grasping finger in a closed position with respect to the setting block of the invention and capturing a golf tee therebetween.
Figure 2:
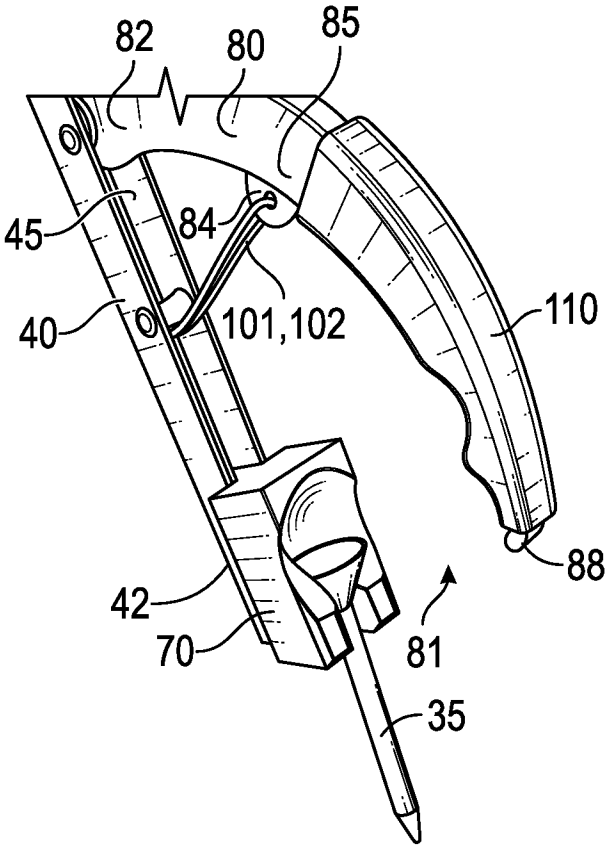
FIG. 2 is an enlarged partial perspective view of a lower end of an elongated body of the invention, illustrating a grasping finger in an open position with respect to a setting block of the invention.
Figure 5:
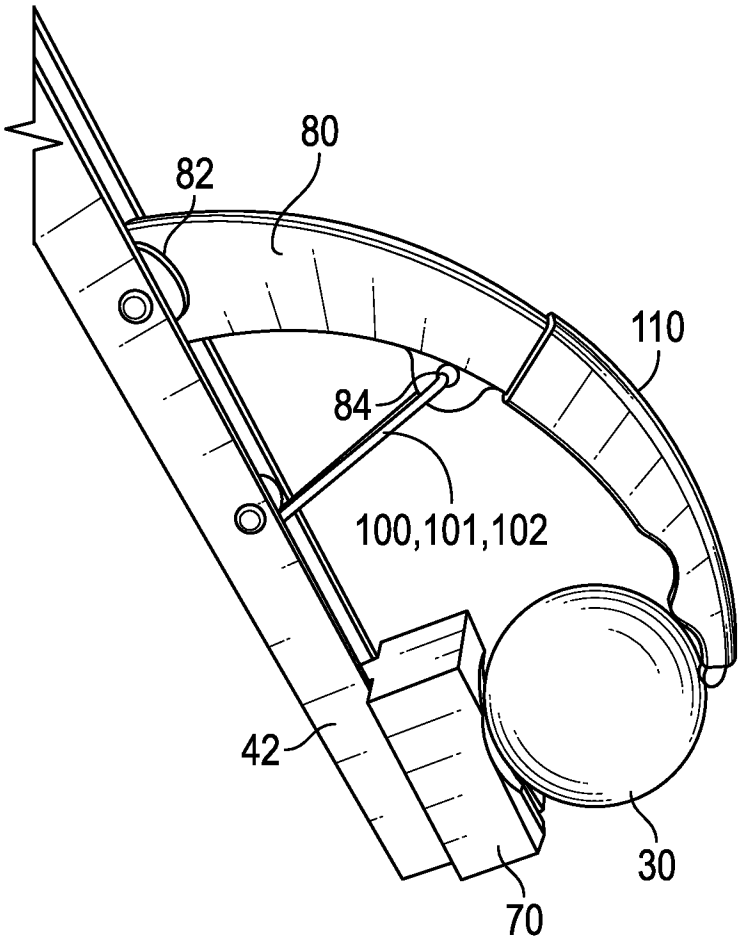
FIG. 5 is an enlarged partial perspective view of the lower end of the elongated body of the invention, illustrating a golf ball captured between the setting block and the grasping finger.
Figure 4:
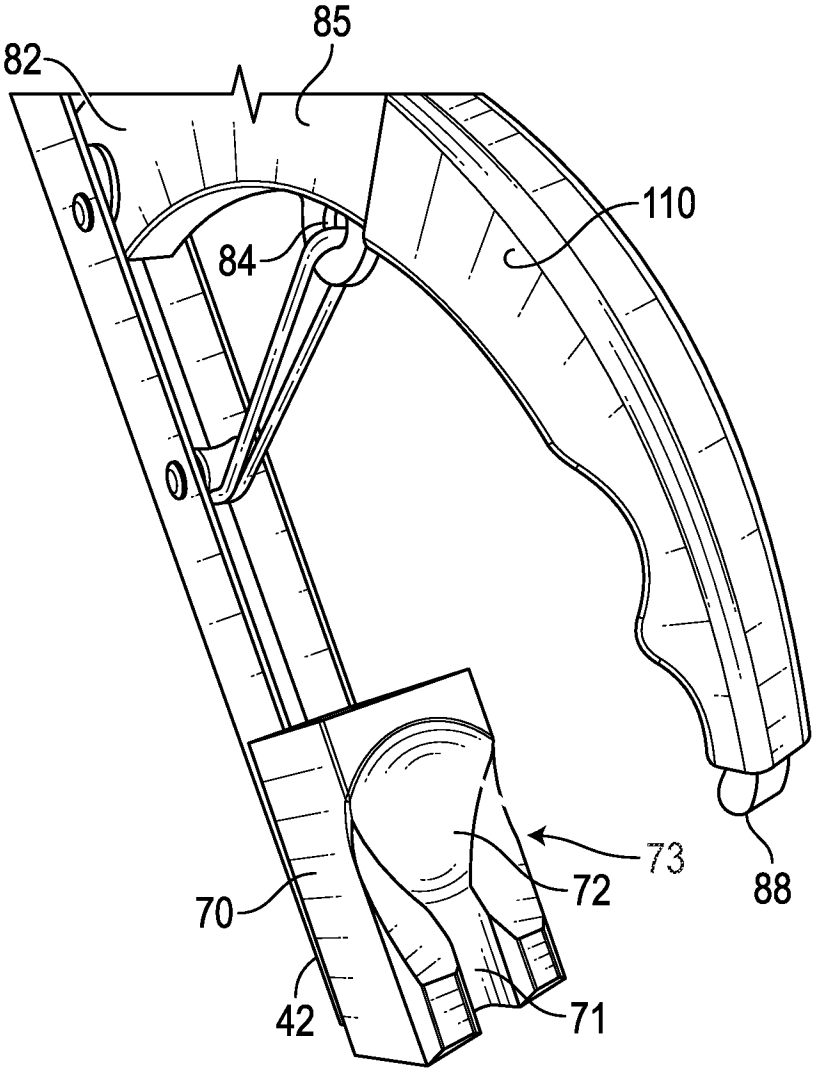
FIG. 4 is an enlarged partial perspective view of the lower end of the elongated body of the invention, illustrating the setting block with the golf tee omitted for clarity of illustration.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-10 illustrate a tool 10 for a golfer 20 for manipulating a golf ball 30 and a golf tee 35. Such a tool 10 is useful for allowing the golfer 20 to manipulate the golf ball 30 and the golf tee 35 without having to bend down to a ground surface 15. The tool 10 includes an elongated body 40 having an upper end 48, a lower end 42, and a channel 45 connecting the upper end 48 with the lower end 42. Preferably the elongated body 40 is made from an extruded, rigid plastic or metal material, and is between twenty-five inches and thirty-two inches in length, allowing the golfer 20 to reach the golf ball 30 laying on the ground surface 15.

A handle 50 is fixed at the upper end 48 of the elongated body 40 and adapted for being grasped by a hand 21 of the golfer 20. The handle 50 is rigid and is preferably made from an injection molded plastic, carved wood, cast or machined metal, or the like.

Figure 6:
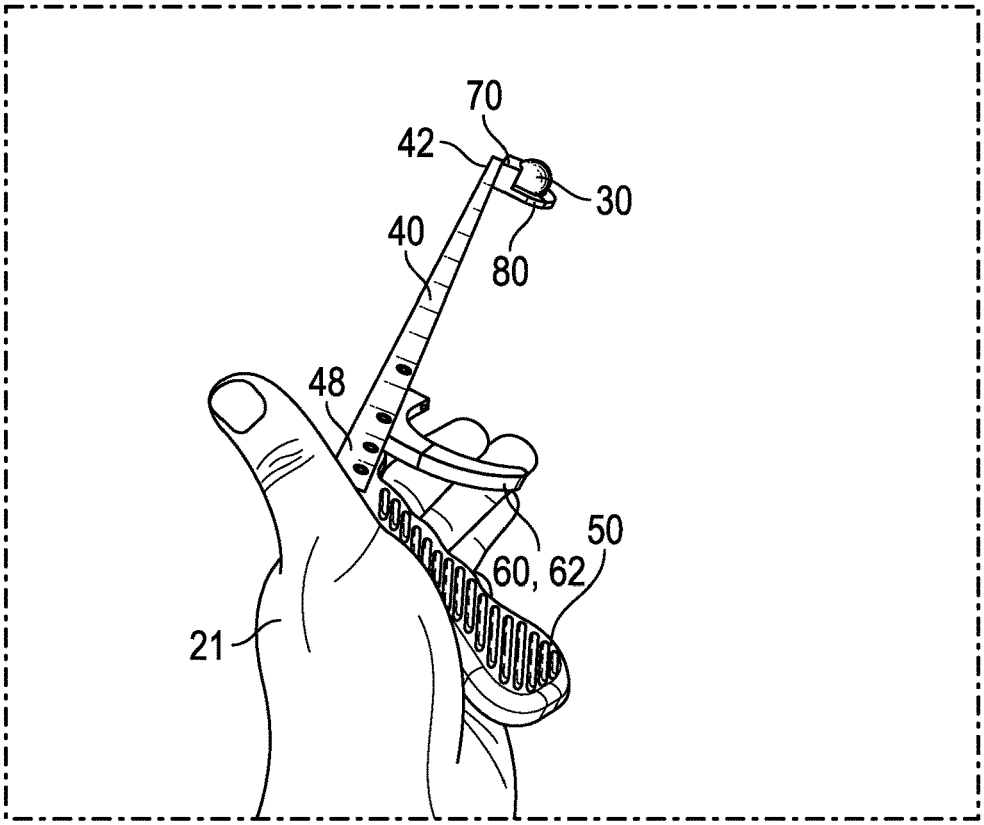
FIG. 6 is a perspective view of the invention, illustrating the golf ball captured between the setting block and the grasping finger.
Figure 7:
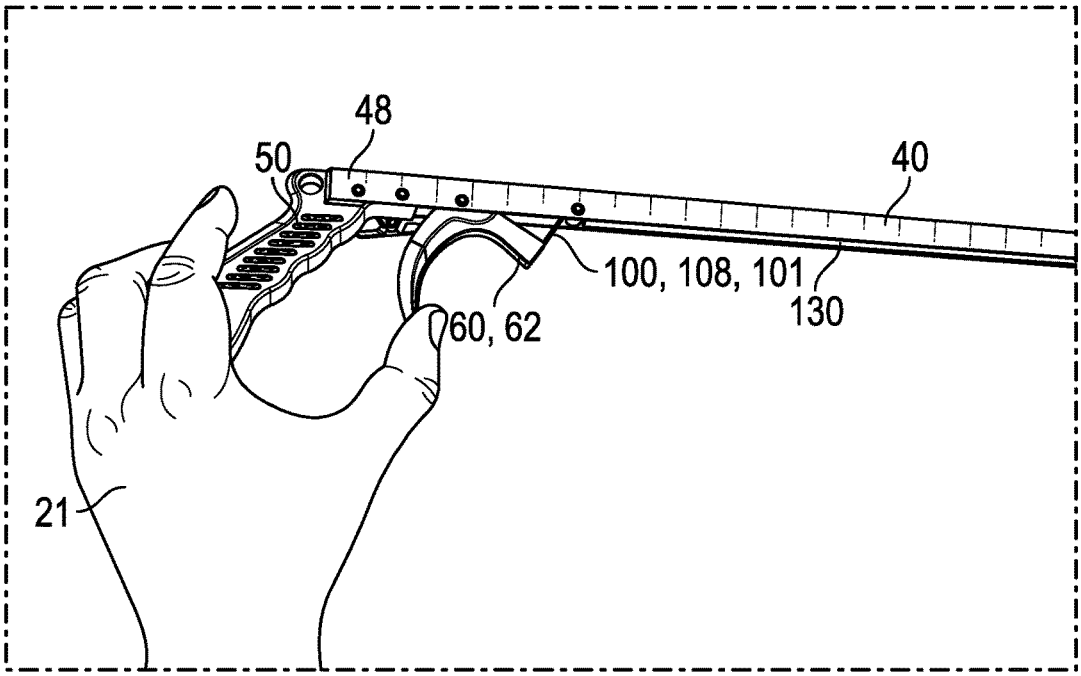
FIG. 7 is an enlarged partial perspective view of an upper end of the elongated body of the invention.
Figure 8:
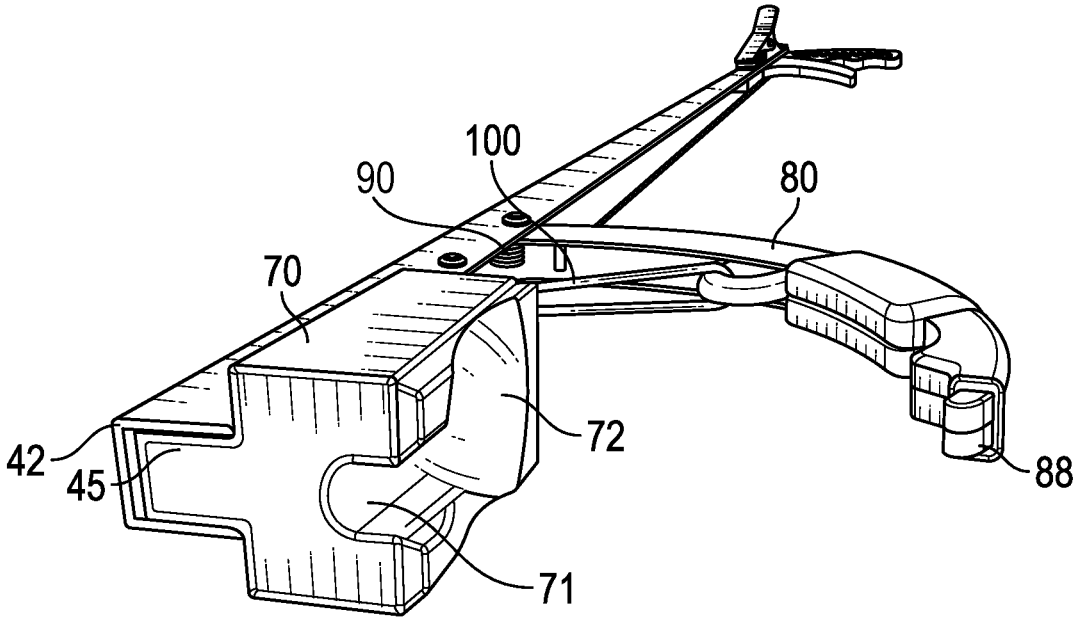
FIG. 8 is a perspective view of the invention, illustrated with the grasping finger in the open position.
Figure 9:
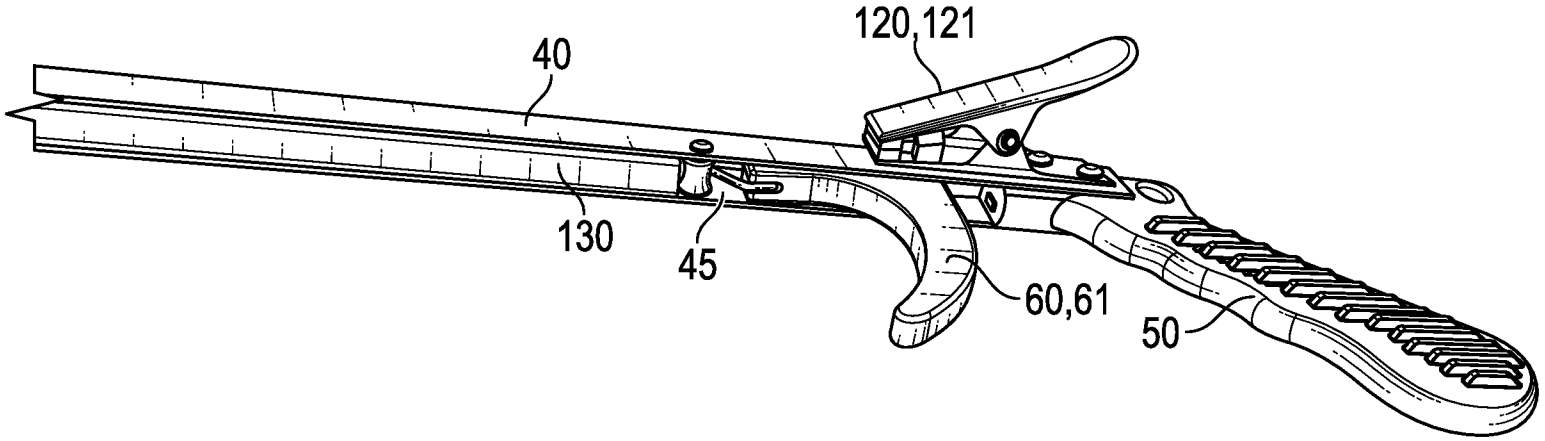
FIG. 9 is an enlarged partial perspective view of the upper end of the elongated body of the invention, illustrated with a spring clip in a closed position.
Figure 10:
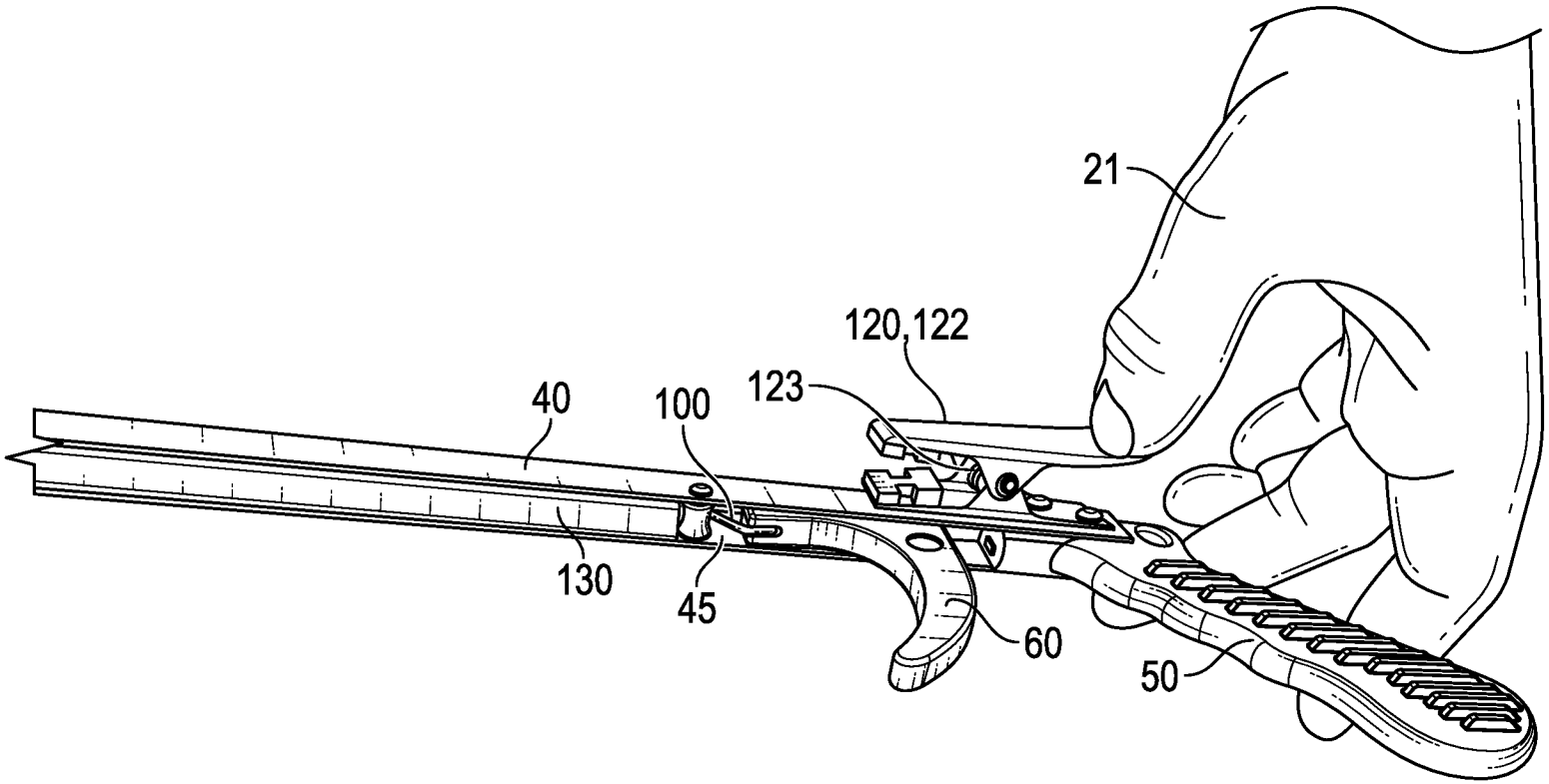
FIG. 10 is an enlarged partial perspective view of the upper end of the elongated body of the invention, illustrated with the spring clip in an open position.

A trigger 60 is fixed proximate the upper end 48 of the elongated body 40 proximate the handle 50 and is adapted to pivot within the channel 45 of the elongated body 40 between a first position 61 (FIG. 9) and a second position 62 (FIGS. 6-7). The trigger 60 is rigid and is preferably made from an injection molded plastic, carved wood, cast or machined metal, or the like.

A rigid setting block 70 is fixed at the lower end 42 of the elongated body 40 and is adapted for receiving either the golf ball 30 or the golf tee 35 partially therein. The setting block 70 includes a tee holder 71 (FIG. 8) and a ball holder 72, both integrally formed in the setting block 70 and allowing use with either the golf ball 30 or the golf tee 35. A uniquely-shaped recess 73 (FIG. 4) in the setting block 70 is designed to accommodate both the golf ball 30 or the golf tee 35, depending on the intent of the golfer 20. The setting block 70 may be fixed to the elongated body 40 with a mechanical fastener (not shown), such as a screw, adhesive, or the like. The setting block 70 is rigid and is preferably made from an injection molded plastic, carved wood, cast or machined metal, or the like.

In some embodiments the setting block 70 is affixed to a pre-existing grasping tool having the elongated body 40, handle 50, trigger 60, grasping finger 80, and linkage 100. Such a pre-existing grasping tool can be adapted to receive the setting block 70, in some embodiments within the channel 45 at the lower end 42 of the elongated body 40, and in other embodiments simply fixed with the lower end 42 of the elongated body 40 with mechanical fasteners (not shown) such as screws, rivets, adhesive, ultrasonic bonding, or the like.

A rigid grasping finger 80 has a proximal end 82, a central portion 85, and a distal end 88. The grasping finger 80 is fixed proximate the lower end 42 of the elongated body 40 proximate the setting block 70, and is adapted to pivot within the channel 45 of the elongated body 40 between an open position 81 and a closed position 89. A spring mechanism 90 (FIG. 8) is adapted to urge the grasping finger 80 towards the open position 81. In some embodiments the grasping finger 80 includes an elastomeric sleeve 110 for increasing friction between the golf ball 30 and the grasping finger 80. The grasping finger 80 is rigid and is preferably made from an injection molded plastic, carved wood, cast or machined metal, or the like.

A linkage 100, such as a flexible string 101, chain (not shown), or the like, is secured at a lower end 102 thereof with the grasping finger 80, and at an upper end 108 thereof with the trigger 60. The linkage 100 substantially traverses the channel 45 of the elongated body 40. As such, the grasping finger 80 moves from the open position 81 to the closed position 89 when the trigger 60 is moved from the first position 61 to the second position 62, respectively. The linkage 100 is preferably secured at the lower end 102 thereof through an aperture 84 (FIGS. 4 and 5) of the central portion 85 of the grasping finger 80.

In use, with the golf tee 35 engaged with the setting block 70, the golfer 20 pulls the trigger 60 towards the second position 62 to cause the grasping finger 80 to lock the golf tee 35 in place in the setting block 70. Thereafter the golfer 20 pulls the trigger 60 towards the second position 62 to cause the grasping finger 80 to lock the golf tee 35 in place in the setting block 70. The golfer 20, even in a standing position, can set the golf tee 35 into the ground surface 15 and release the trigger 60 to cause the grasping finger 80 to release the golf tee 35. Once the golf tee 35 is set into the ground surface 15, the golfer 20 can lift the tool 10, set the golf ball 30 into the setting block 70, and pull the trigger 60 again towards the second position 62 to lock the golf ball 30 in place in the setting block 70. The golfer 20 can then, still in the standing position, place the golf ball 30 onto the golf tee 35, release the trigger 60, thereby releasing the golf ball 30 onto the golf tee 35, all without the golfer 20 having to bend down.

In some embodiments a spring clip 120 (FIGS. 9 and 10) is included proximate the upper end 48 of the elongated body 40. The spring clip 120 can be manually positioned between a closed position 121 and an open position 122, the spring clip 120 being urged by a spring 123 into the closed position 121. As such, the spring clip 120 can be used to clip the tool 10 onto pants 22 of the golfer 20 for convenient transport.

Preferably the channel 45 of the elongated body 40 can be closed around the linkage 100 with an elongated channel cover 130 (FIG. 9), the elongated channel cover 130 fixed with the elongated body 40 with one or more mechanical fasteners (not shown), such as rivets, screws, adhesive, ultrasonic bonding, or the like. Alternately the elongate channel cover 130 can be formed integrally with the elongated body 40 so that the channel 45 through which the linkage 100 traverses is enclosed.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A tool for a golfer for manipulating a golf ball and a golf tee, comprising:

an elongated body having an upper end, a lower end, and a channel connecting the upper end with the lower end;

a handle fixed at the upper end of the elongated body and adapted for being grasped by a hand of the golfer;

a trigger fixed proximate the upper end of the elongated body proximate the handle and adapted to move within the channel of the elongated body between a first position and a second position;

a setting block fixed at the lower end of the elongated body, the setting block including a ball holder adapted to receive the golf ball therein such that the entire golf ball is disposed outside of the channel of the elongated body when the golf ball is received within the ball holder, the setting block further including a tee holder adapted to receive the golf tee therein such that the entire golf tee is disposed outside of the channel of the elongated body when the golf tee is received within the tee holder;

a grasping finger having a proximal end, a central portion, and a distal end, the grasping finger fixed proximate the lower end of the elongated body proximate the setting block and adapted to move within the channel of the elongated body between an open position and a closed position;

a spring mechanism adapted to urge the grasping finger towards the open position;

a linkage secured at a lower end thereof with the grasping finger, and at an upper end thereof with the trigger, the linkage substantially traversing the channel of the elongated body and causing the grasping finger to move from the open position to the closed position when the trigger is moved from the first position to the second position, respectively;

whereby with the golf tee received within the tee holder of the setting block, the golfer pulls the trigger towards the second position to cause the grasping finger to lock the golf tee in place in the setting block, whereupon the golfer in a standing position can set the golf tee into a ground surface and release the trigger to cause the grasping finger to release the golf tee, after which the golfer can lift the tool, set the golf ball within the ball holder of the setting block, and pull the trigger towards the second position to lock the golf ball in place in the setting block, whereupon the golfer in the standing position can place the golf ball onto the golf tee, and release the trigger to thereby release the golf ball atop the golf tee.

2. The tool of claim 1 wherein the distal end of the grasping finger includes an elastomeric sleeve.

3. The tool of claim 1 further comprising a spring clip fixed proximate the upper end of the elongated body, whereby the spring clip can be used to clip the tool onto pants of the golfer for convenient transport.

4. The tool of claim 1 wherein the linkage is closed within the channel of the elongated body by an elongated channel cover.

5. The tool of claim 1 wherein the linkage is a flexible string.

6. The tool of claim 5 wherein the flexible string is secured at the lower end thereof through an aperture of the central portion of the grasping finger.

7. The tool of claim 1 wherein the elongated body is between twenty-five inches and thirty-two inches in length.

8. A tool for a golfer for manipulating a golf ball and a golf tee, comprising:

an elongated body having an upper end, a lower end, and a channel connecting the upper end with the lower end, the elongated body being between twenty-five inches and thirty-two inches long;

a handle fixed at the upper end of the elongated body and adapted for being grasped by a hand of the golfer;

a trigger fixed proximate the upper end of the elongated body proximate the handle and adapted to move within the channel of the elongated body between a first position and a second position;

a setting block fixed at the lower end of the elongated body, the setting block including a ball holder adapted to receive the golf ball therein such that the entire golf ball is disposed outside of the channel of the elongated body when the golf ball is received within the ball holder, the setting block further including a tee holder adapted to receive the golf tee therein such that the entire golf tee is disposed outside of the channel of the elongated body when the golf tee is received within the tee holder;

a grasping finger having a proximal end, a central portion, and a distal end, the grasping finger fixed proximate the lower end of the elongated body proximate the setting block and adapted to move within the channel of the elongated body between an open position and a closed position, the distal end of the grasping finger including an elastomeric sleeve;

a spring mechanism adapted to urge the grasping finger towards the open position;

a linkage secured at a lower end thereof through an aperture of the central portion of the grasping finger, and at an upper end thereof with the trigger, the linkage substantially traversing the channel of the elongated body and causing the grasping finger to move from the open position to the closed position when the trigger is moved from the first position to the second position, the linkage being a flexible string closed within the channel of the elongated body by an elongated channel cover;

a spring clip fixed proximate the upper end of the elongated body;

whereby with the golf tee received within the tee holder of the setting block, the golfer pulls the trigger towards the second position to cause the grasping finger to lock the golf tee in place in the setting block, whereupon the golfer in a standing position can set the golf tee into a ground surface and release the trigger to cause the grasping finger to release the golf tee, after which the golfer may lift the tool, set the golf ball within the ball holder of the setting block, and pull the trigger towards the second position to lock the golf ball in place in the setting block, whereupon the golfer in the standing position can place the golf ball onto the golf tee, and release the trigger to thereby release the golf ball, the spring clip being thereafter used to clip the tool onto pants of the golfer for convenient transport.

9. An improvement on a grabbing tool for a golfer for manipulating a golf ball and a golf tee, the grabbing tool being of the type having an elongated body having an upper end, a lower end, and a channel connecting the upper end with the lower end; a handle fixed at the upper end of the elongated body and adapted for being grasped by a hand of the golfer; a trigger fixed proximate the upper end of the elongated body proximate the handle and adapted to move within the channel of the elongated body between a first position and a second position; a grasping finger having a proximal end, a central portion, and a distal end, the grasping finger fixed proximate the lower end of the elongated body and adapted to move within the channel of the elongated body between an open position and a closed position; a spring mechanism adapted to urge the grasping finger towards the open position; and a linkage secured at a lower end thereof with the grasping finger, and at an upper end thereof with the trigger, the linkage substantially traversing the channel of the elongated body and causing the grasping finger to move from the open position to the closed position when the trigger is moved from the first position to the second position, respectively; the improvement comprising:

a setting block fixed at the lower end of the elongated body, the setting block including a ball holder adapted to receive the golf ball therein such that the entire golf ball is disposed outside of the channel of the elongated body when the golf ball is received within the ball holder, the setting block further including a tee holder adapted to receive the golf tee therein such that the entire golf tee is disposed outside of the channel of the elongated body when the golf tee is received within the tee holder;

whereby with the golf tee received within the tee holder of the setting block, the golfer pulls the trigger towards the second position to cause the grasping finger to lock the golf tee in place in the setting block, whereupon the golfer in a standing position can set the golf tee into a ground surface and release the trigger to cause the grasping finger to release the golf tee, after which the golfer can lift the grabbing tool, set the golf ball within the ball holder of the setting block, and pull the trigger towards the second position to lock the golf ball in place in the setting block, whereupon the golfer in the standing position can place the golf ball onto the golf tee, and release the trigger to thereby release the golf ball atop the golf tee.

10. The tool of claim 1 wherein the ball holder and the tee holder of the setting block are each disposed outside of the channel of the elongated body.

11. The tool of claim 1 wherein the setting block further includes a first portion and a second portion fixed to the first portion, the second portion of the setting block including the ball holder and the tee holder integrally formed therein, the first portion of the setting block being disposed within the channel of the elongated body and the second portion of the setting block being disposed outside of the channel of the elongated body.

12. The tool of claim 8 wherein the ball holder and the tee holder of the setting block are each disposed outside of the channel of the elongated body.

13. The tool of claim 8 wherein the setting block further includes a first portion and a second portion fixed to the first portion, the second portion of the setting block including the ball holder and the tee holder integrally formed therein, the first portion of the setting block being disposed within the channel of the elongated body and the second portion of the setting block being disposed outside of the channel of the elongated body.

14. The improvement of claim 9 wherein the ball holder and the tee holder of the setting block are each disposed outside of the channel of the elongated body.

15. The improvement of claim 9 wherein the setting block further includes a first portion and a second portion fixed to the first portion, the second portion of the setting block including the ball holder and the tee holder integrally formed therein, the first portion of the setting block being disposed within the channel of the elongated body and the second portion of the setting block being disposed outside of the channel of the elongated body.

* * * * *